US006419758B1

(12) United States Patent
Bewlay et al.

(10) Patent No.: US 6,419,758 B1
(45) Date of Patent: Jul. 16, 2002

(54) CATHODE WIRE FILAMENT FOR X-RAY TUBE APPLICATIONS

(75) Inventors: Bernard Patrick Bewlay; Dennis Joseph Dalpe, both of Schenectady; Bruce Alan Knudsen, Amsterdam, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/394,212

(22) Filed: Sep. 10, 1999

(51) Int. Cl.[7] ..... C22C 27/04
(52) U.S. Cl. ..... 148/273; 148/673
(58) Field of Search ..... 420/430, 432; 148/673, 423

(56) References Cited

U.S. PATENT DOCUMENTS 3,989,549 A * 11/1976 Cangiano et al. ..... 148/6.3
5,389,853 A * 2/1995 Bigio et al. ..... 313/341
5,498,185 A 3/1996 Knudsen et al.
5,515,413 A 5/1996 Knudsen et al.
5,672,085 A 9/1997 Knudsen et al.

FOREIGN PATENT DOCUMENTS

JP 60224742 A * 11/1985

OTHER PUBLICATIONS

The Plasticity and Creep of Metals and Ceramics, Pergamon, (1982), 5 pages.
Transactions of ASM, vol. 55 (1962) Properties of Tungsten–Rhenium Lamp Wire, JW Pugh, LH Amra and DT Hurd, pp 451–459.

* cited by examiner

*Primary Examiner*—Roy King
*Assistant Examiner*—Harry D. Wilkins, III
(74) *Attorney, Agent, or Firm*—Robert P. Santandrea; Noreen C. Johnson

(57) ABSTRACT

An x-ray cathode filament comprises a recrystallized coiled wire that comprises rhenium in a range from about 3 to about 7 weight percent with the balance being tungsten that is doped with potassium at a concentration in a range from about 30 to about 110 PPM. The filament comprises interlocked grains of an average size greater than about 20 microns.

16 Claims, 1 Drawing Sheet

CATHODE WIRE FILAMENT FOR X-RAY TUBE APPLICATIONS

BACKGROUND OF THE INVENTION

The invention relates to x-ray filaments used as the cathode member of an x-ray tube for use in diagnostic and therapeutic radiology machines, for example computerized axial tomography (CAT) scanners. More specifically, the invention is directed to a x-ray filament having a morphology and composition exhibiting ductility and thermal and mechanical shock resistance, and a method of manufacturing the same.

A conventional x-ray tube assembly, which is typically enclosed in an oil-filled protective lead casing to absorb produced heat, comprises a glass envelope containing a cathode member, a rotating disc target which forms the anode, and a rotor. The rotor forms part of a motor assembly that spins the target. A stator is provided external of the x-ray tube proximate to the rotor, overlapping about two-thirds the length thereof. The glass envelope is provided with a window to permit the exit of the x-rays generated by the x-ray tube.

The production of x-rays results from the sequential release, acceleration and abrupt stoppage of electrons generated within a vacuum, in the x-ray tube. In order to release electrons, the cathode member that includes a helical wire filament positioned in a cathode cup, is electrically heated to incandescence by means of the passage of electrical current there through. Subsequently, the released electrons are accelerated by the application of a high voltage of the order of from about ten thousand to several hundred thousands of volts between the cathode and the anode of said x-ray tube. Directionally controlled impingement of the accelerated released electrons upon the rotating target anode causes stoppage of the electrons thereupon at different points upon the anode perimeter and consequent release of x-rays. The high voltages required to operate the x-ray tube are supplied by a transformer, the alternating current being rectified utilizing rectifier tubes or alternatively by barrier-layered rectifiers.

The electrons from which x-rays are generated are provided by the cathode assembly comprising a coiled filament cathode housed in a metallic cup. Heretofore, such wire filaments have been constructed from a potassium-doped tungsten wire, which exhibits excellent structural stability and focusing characteristics at the high operational temperatures required for electron emission and x-ray generation. X-ray tube performance can be affected by the alignment of the filament in the cathode, thus the coiled tungsten filaments were assembled and then aligned in the cathode cup. Once assembled, the filaments were heated to about 2800° C. to produce the desired recrystallized microstructure. During this heating, the filaments often sagged, move out of alignment, thus necessitating realignment thereof and repetition of the heat treatment step.

This sagging and alignment problem was addressed in U.S. Pat. Nos. 5,498,185; 5,514,413; and 5,672,085 all issued to B. A. Knudsen et al., and assigned to the assignee of the instant application, the disclosures of which are herein incorporated by reference. These patents, which include detailed descriptions of the prior art x-ray tubes assemblies, are directed to methods of filament alignment and to the provision of a x-ray tube cathode assembly having a solid, one-piece insulator unit associated therewith.

Recrystallized, doped tungsten filaments possesses low ductility at room temperature and the recrystallized cathodes become extremely brittle. Furthermore, such doped tungsten filaments exhibit major deficiencies in applications wherein there is substantial thermal and mechanical shock. The thermal shock can be generated, for example, by rapid thermal cycling of the filament during exposure to a rapid cycling CAT x-ray system. Under these conditions, the filament temperature is raised almost instantaneously to emission temperatures of about 2500° C. The high-speed rotation and counter rotation in the gantry of a scanning CAT x-ray system, for example, may generate high mechanical shock, AND such systems becoming an increasingly important application for this type of x-ray tube.

It is known to construct filaments for incandescent lamps from a tungsten-rhenium alloy wherein the rhenium content is in a range from about 3 to about 30 percent by weight (w/o) with the balance comprising tungsten. The addition of rhenium to tungsten and doped-tungsten was recognized as providing the benefit of increasing the ductility, which enhances resistance to thermal and mechanical shock. However, such tungsten-rhenium wire of the prior art generally possessed a fine equiaxial microstructure which detrimentally affected the creep performance of filaments made therefrom and caused sagging of such filament wire when exposed to high temperature. Sagging of filaments due to creep is a recognized cause of misalignment of the cathode wire filament within the cathode cup (discussed above) and is known to result in improper focusing of x-rays emanating from such filament. The service life of a filament member of tungsten-rhenium was generally thought to be limited due to such creep and the resultant creep failure, which would ensue at the high temperatures, and over the time period over which x-ray filaments operate. Accordingly, at high temperatures in the range of above 2300° C. (the temperature at which x-ray tubes typically operate), the prior art has recognized the unsuitability of tungsten-rhenium wire due to the significant creep at these temperatures. (ref. H. J. Frost and M. F. Ashby, "Deformation Maps—The Plasticity and Creep of Metals and Ceramics", pp. 150–152, Pergamon, 1982.)

SUMMARY OF THE INVENTION

The invention provides a heat-treated, recrystallized, potassium-doped tungsten-rhenium filament, suitable for high temperature operation in the cathode assembly of a x-ray tube. The filament comprises enhanced creep life over tungsten and doped-tungsten filaments. The filament, as embodied by the invention, is subjected to a heat-treatment step that defines a recrystallized, generally uniform microstructure having a grain size greater than about 20 microns. The magnitude of the grain size provides enhanced creep strength concomitant with the retention of thermal and shock resistance properties inherent in tungsten-rhenium filaments. In particular, the x-ray filament of the invention comprises rhenium in a range from about 3.0 to about 7.0 weight percent, and potassium in a range from about 30 to about 110 PPM, with tungsten making up the balance of the composition, and possessing interlocked grains of a grain size greater than about 20 microns.

Prior to installation within the cathode cup, the filament of the invention is heat-treated at temperatures in a range from about between 2600° C. to about 3230° C. and for a time in a range from about 0.1 minutes to about 5 hours, for example in the range from about 3170° C. to about 3230° C. for a period in a range from about 1.5 to about 3.0 minutes, and alternatively heated in a range from about 2870° C. to about 2930° C. for a time period of approximately 4 hours, so as to alone or in combination with a drawing schedule, produce a filament having interlocked grains with an average grain size greater than about 20 microns.

The filament, as embodied by the invention, permits the use of tungsten-rhenium wire filaments in x-ray devices, and permits the consequent advantages of tungsten-rhenium filaments to be realized. By addition of potassium doping within certain ranges and further adjusting grain size through heat treatment and/or forming processes to produce grain size in excess of about 20 microns, the benefits of tungsten-rhenium filaments can be obtained in x-ray applications, including but not limited to resistance to at least one of thermal and mechanical shock over known tungsten and doped-tungsten filaments.

More particularly, the invention comprises a x-ray filament adapted for use as the cathode of an x-ray tube, which comprises a coiled wire having a composition comprising rhenium in a range from about 3.0 to about 5.5 weight percent, with the balance being tungsten and being doped with potassium in a range from about 30 to about 110 PPM, and having interlocked grains of a grain size greater than about 20 microns.

In a further aspect of the invention, a method of making a coiled wire filament for use as the cathode of an x-ray tube comprises:

(i) forming a wire member, substantially comprising rhenium in a range from about 4 to about 6 weight percent with the balance being tungsten doped with potassium in a range from about 30 to about 110 PPM, from a rod in a series of one or more drawing passes, each drawing pass reducing the cross sectional area of the wire member;

(ii) the cumulative reduction in cross sectional area of said wire member being at least about 40 per cent;

(iii) forming coils in said wire member; and (iv) thereafter heat treating said wire member by heating to a temperature in the range from about 2600° C. to 3230° C. for a time period in a range from about 0.1 minutes to about 5 hours; to produce a filament having an interlocked grain structure of average grain size in excess of about 20 microns.

These and other aspects, advantages and salient features of the invention will become apparent from the following detailed description, which, when taken in conjunction with the annexed drawings, where like parts are designated by like reference characters throughout the drawings, disclose embodiments of the invention.

DESCRIPTION OF THE INVENTION

Figure 1:
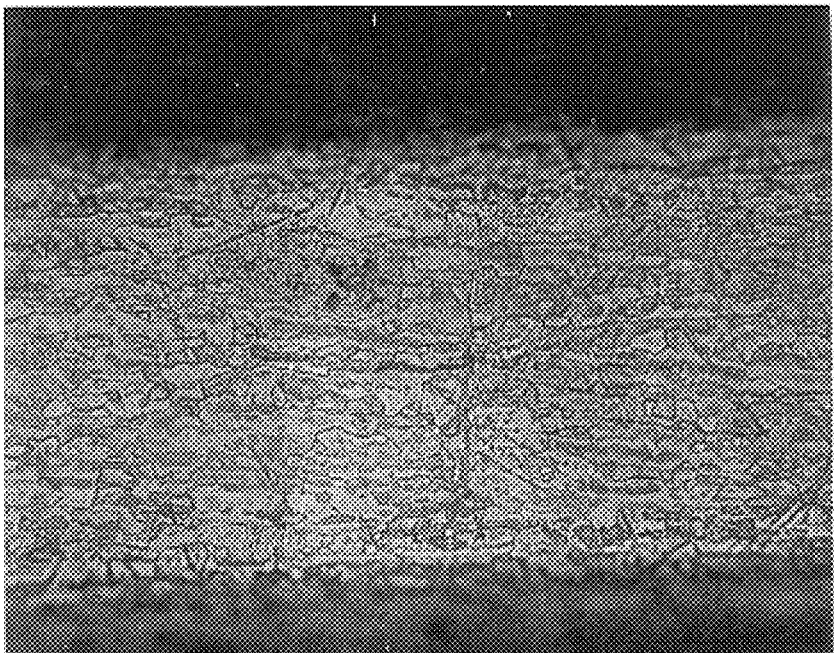
FIG. 1 is a scanning electron microphotograph taken at a 500× times magnification of a tungsten-3% rhenium filament containing 55 PPM potassium that was heat treated at 2600° C. for 1 hour.

The potassium-doped tungsten-rhenium wires of the invention find particular application when formed into a coiled filament for use as the cathode in the construction of any conventional x-ray tube or alternatively in the cathode cup assembly described in the U.S. Pat. No. 5,515,413.

The potassium-doped tungsten-rhenium wires of the invention are manufactured having a potassium content in a range from about 30 to about 110 PPM, such as in a range from about 55 to about 70 PPM. Such potassium in a fully sintered tungsten-rhenium ingot is typically present in elongate strands of elemental potassium bubbles. Generally, higher potassium concentrations provide filaments with higher creep performance, but wire making is more difficult at higher potassium levels. The rhenium content is in a range from about 3 to about 7 weight percent (w/o), but most typically about 3 (w/o). Tungsten makes up the balance of the composition.

The heat treatment step has been conducted following assembly and installation of the cathode cup in the x-ray tube, being performed in a furnace prior to assembly of the filament in the cathode cup, using a controlled temperature heat treatment or heat treatment cycle. Alternatively, the heat treatment step may be conducted using self-resistance heating. The potassium-doped tungsten-rhenium wire is formed into the desired filament configuration as further described herein. The filament, supported both internally and externally using tungsten tooling, is positioned within a furnace and subjected to a heat treatment step. This heat treatment step is functional to effect recrystallization of the filament and controls the resultant microstructure of the filament determining grain growth and the ultimate grain size. Typically, the heating would take place at temperatures in a range from about 2600° C. to about 3200° C. for times in a range from about 0.10 minutes to about 5 hours depending on certain factors as enumerated herein, in order to achieve the desired grain size of greater than about 20 microns and the resultant resistance to creep failure.

Under the conditions of a heat treatment step, as embodied by the invention, the filament is provided with a recrystallized structure and grain sizes greater than about 20 microns. The creep strength of the filament is obtained without compromising the thermal and mechanical shock resistance properties of the filament, because of this grain structure.

The tungsten-rhenium filaments generally have a recrystalization temperature higher than the maximum service temperature of the filament, and accordingly heat treatment above such maximum service temperature and above such recrystalization temperature produces a recrystalized grain structure. However, at elevated heat treatment temperatures, premature failure of the resultant heat-treated filament can result due to excessive potassium bubble growth and/or evaporation during the heat treatment process. Accordingly, the recrystallization time and grain growth during heat treatment is need be adjusted so as to enhance increased grain size concomitant with minimum bubble growth.

Tungsten-rhenium filaments of the invention are made in accordance with the following steps. Substantially pure tungsten powder is mixed and sifted with the appropriate desired weight percent of rhenium powder, and elemental potassium in concentrations of 30–110 PPM is added or may be present as an impurity. A fixed amount of mixed powder is weighed and placed in a steel mold, and placed into a hydraulic press. After pressing in the press, the resultant pressed ingot bar, typically about ½" about ½" (127mm×127 mm) in cross-sectional area, is placed in a retractory container ("boat") and thereafter placed in a furnace with a hydrogen atmosphere. The ingot is then subject to a presintered step by being maintained in such furnace for a period at 1200° C. Thereafter, the ingot is subject to full sintering by resistance heating in a hydrogen atmosphere by passing an electric current through the bar. During such process tungsten crystals begin to form with the bar, as well as elongate chains of potassium bubbles.

The bar is thereafter swaged to rod by raising to a temperature in a range from about 1200° C. to about 1600° C. and passed through a die, which is designed to rapidly hammer the bar .at about 10,000 blows per minute. Swaging elongates the crystals formed within the rod, creating a desired fibrous structure. Swaging devices typically reduce the diameter of the rod by about 12% per pass. After two or more swages the rod may need to be recrystallized by heating to a temperature in excess of approximately 2500° C., in order to conduct any further swaging of the rod. Further swaging, with possible additional recrystallization steps, may be conducted until the resultant rod is in a range from about 0.25 to about 0.10 inches (6.3 and 2.5 mm, respectively).

The swaged wire rod is thereafter drawn through one or more dies of tungsten carbide or diamond, in one ore more drawing passes, each drawing pass further reducing the diameter of the rod. Low temperature (in a range from about 1200° C. to about 1600° C.) and/or high temperature (above the recrystallization temperature) heat treatments may be necessary after a number of drawing passes in order to allow further drawing passes to achieve the desired reduction in diameter to the desired wire size. The typical desired diameter of x-ray filament is in the range of about 0.010 to about 0.025 inches (0.254 mm to 0.63 mm respectively).

The subsequent steps after the formation of a swaged rod of drawing (with intermediate high or low temperature stress anneals), and the duration and temperature of the final heat treatment all have an effect in various degrees on the formation of interlocked grains and the average grain size of grains formed in the resultant wire member. Thus, one method, as embodied by the invention, after formation of a swaged rod (typically in a range from about 0.10 to about 0.25 inches in diameter), such rod is drawn one or more times through a die in one or more drawing passes, each drawing pass reducing the diameter of the wire. Upon reaching the desired diameter for the filament (for example about 0.010 inches (2.54 mm) helical coils are formed in the wire member, and thereafter such wire number is recrystallized by heating to a temperature in the range from about 2600° C. to about 3230° C. for a period in a range from about 0.1 minutes to about 5 hours, so as to produce an interlocked grain structure within the wire member having an average grain size in excess of about 20 microns.

Generally, the higher the temperature and the greater the length of time of final heat treatment, the greater the grain size. The grain size and the degree of interlocking is dependant not only on the final recrystallization heat treatment, but also dependant upon the amount of recrystallization (if any) during the swaging process, as well as the particular rhenium percentage utilized in a range from about 3 to about −7 (w/o).

The following examples are provided to illustrate the invention. The examples are not intended to limit the invention in any way, and merely set forth features that are within the scope of the invention.

EXAMPLE 1

Substantially pure (99.5%) tungsten powder is mixed with an appropriate weight of substantially pure (99.8%) rhenium powder, to form a tungsten-3 weight percent rhenium mixture having elemental potassium in a concentration of 55 PPM. The mixed powder is pressed to form a resultant ingot of about ½" by about ½" in cross-sectional area, and such ingot placed in a furnace having a hydrogen atmosphere, and pre-sintered at about 1200° C. Thereafter the ingot is resistance-heated in a hydrogen atmosphere by passing an electric current through the bar at about 90% of fusion amperage. Thereafter, the resultant bar is swaged to about a 0.25 inch (6.3 mm) diameter rod at a temperature in a range from about 1200° C. to about 1600° C., by a series of successive swages. The rod received an intermediate recrystallization heat treatment of about 2500° C. prior to final swaging to about 0.25 inch diameter. The resultant rod is thereafter subject to a number of drawing passes through forming dies, and subject to a low temperature intermediate anneal of about 1200° C. prior to the last drawing step, wherein the resultant diameter produced is about 0.010 inches (254 mm). The filament is then subject to a final heat treatment at about 2600° C. for about 60 minutes.

FIG. 1 shows the resultant microstructure of the filament at 500× times magnification. The average grain size is about 8 microns.

In the following non-limiting example set out below (Example 2), the altered recrystallization time and temperature was found to produce the requisite interlocked grain structure and average grain size in excess of about 20 microns for a wire filament of a tungsten-3 (w/o) rhenium wire filament, so as to produce a filament with resistance to creep

EXAMPLE 2

A 0.010 inch diameter tungsten-3 (w/o) rhenium wire obtained in Example 1 was used, but rather than subjecting it to a final heat treatment of about 60 minutes at about 2600° C., the wire is subject to a final heat treatment (recrystallization) of about 3200° C. for about 2 minutes.

Figure 2:
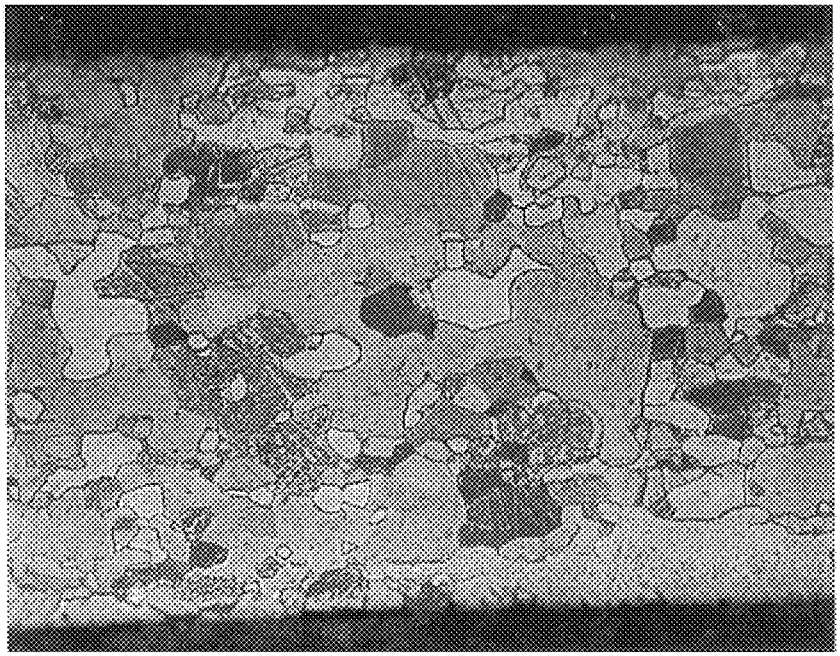
FIG. 2 is a scanning electron microphotograph taken at a 500× times magnification of a tungsten-3% rhenium filament containing 55 PPM potassium that was heat treated at 3200° C. for two minutes.

FIG. 2 shows the resultant microstructure, under 500× times magnification, showing the larger achieved grain size of greater than about 20 microns.

At temperatures required for electron emission in a x-ray tube, the creep life of such filament was found to be satisfactory with respect over the wire of Example 1. The resultant filament member further exhibited ductibility over conventional tungsten filaments and possessed comparable yield strength.

While various embodiments are described herein, it will be appreciated from the specification that various combinations of elements, variations or improvements therein may be made by those skilled in the art, and are within the scope of the invention.

We claim:

1. An x-ray wire filament for use as the cathode of an x-ray tube, the filament comprising a heat treated recrystallized coiled wire member that has undergone a heat treatment, the filament comprising rhenium in a range from about 3 to about 7 weight percent with the balance being tungsten and doped with potassium in a range from about 30 to about 110 PPM, the filament being fully recrystallized and distortion-free and comprising interlocked grains of an average grain size greater than about 20 microns.

2. The filament as set forth in claim 1, wherein said heat treatment comprises heating said filament member to a temperature greater than 2700° C. and up to about 3200° C. for a time period ranging between about 0.1 minutes to about 5 hours.

3. The filament as set forth in claim 2, wherein said heat treatment comprises heating said coiled wire to a temperature in the range of between about 3170° C. and about 3200° C. for a time period in a range from about 1.5 to about 3.0 minutes.

4. The filament as set forth in claim 2, wherein said heat treatment comprises heating said coiled wire to a temperature in the range of about 2870° C. to 2930° C. for a time period of approximately 4 hours.

5. The filament as set forth in claim 2, wherein said rhenium is provided in a range from about 3.0 to about 5.5 weight percent.

6. The filament as set forth in claim 5, wherein said potassium is provided in a range from about 40 to about 70 PPM.

7. A heat treated, recrystallized filament for use as a cathode of an x-ray tube, said filament having undergone a heat treatment and comprising a coiled wire member having a composition comprising about 4 to about 6 weight percent rhenium, with the balance being tungsten and doped with between about 30 to about 70 PPM potassium, said wire being heat treated to a temperature greater than 2700° C. and up to about 3200° C. for a time period between about 0.1 minutes to about 4 hours, wherein said filament is fully recrystallized and distortion-free and comprises interlocked grains having an average grain size greater than about 20 microns.

8. The filament as set forth in claim 7, wherein said heat treatment comprises heating said coiled wire to a temperature in the range of between about 3170° C. and about 3200° C. for a time period of about 2 minutes.

9. The filament as set forth in claim 7, wherein said heat treatment comprises heating said coiled wire to a temperature in the range of about 2870 to about 2930° C. for a time period of about 4 hours.

10. A method of making a coiled wire filament for use as the cathode of an x-ray tube, the method comprising:

forming a wire member, the wire member comprising between about 4 to about 6 weight percent rhenium with the balance being tungsten doped with between about 30 to about 70 PPM potassium, from a swaged rod in a series of one or more drawing passes, each drawing pass reducing the cross sectional area of the wire member; the cumulative reduction in cross sectional area of said wire member being at least about 40 percent;

forming coils in said wire member; and heat treating said wire member by heating to a temperature in the range of between about 2600° C. to about 3230° C. for a time period between about 0.1 minutes to about 5 hours; whereby a filament having an interlocked grain structure of average grain size in excess of about 20 microns is produced.

11. The method as claimed in claim 10, wherein said wire is formed from a rod after at least two drawing passes, the method further comprising the step of providing a stress anneal prior to a last drawing pass.

12. The method as claimed in claim 11, wherein said stress anneal is a low temperature stress anneal below the recrystallization temperature of the wire member.

13. The method as claimed in claim 11, wherein said stress anneal comprises an elevated temperature stress anneal above the recrystallization temperature of the wire member.

14. The method as claimed in claim 10, wherein said heat treating comprises heating said wire member to a temperature in the range of about 3170° C. to 3230° C. for a time period of about 2 minutes.

15. The method as claimed in claim 10, wherein said heat treating comprises heating said wire member to a temperature in the range of about 2870° C. to about 2930° C. for a time period of about 4 hours.

16. A method of making a coiled wire filament for use as the cathode of an x-ray tube, the method comprising the steps of:

(i) forming a wire member comprising between about 4 to about 6 weight percent rhenium with the balance being tungsten doped with between about 30 to about 70 PPM potassium from a rod in a series of drawing passes, each drawing pass reducing the cross-sectional area of the wire member;

(ii) providing a low temperature stress anneal below the recrystallization temperature of the wire member after at least one of said drawing passes;

(iii) providing at least one drawing pass after said anneal such that the cumulative reduction in cross-sectional area of said wire member after said anneal is at least about 40 per cent;

(iv) forming coils in said wire member; and (v) thereafter heat treating said wire member by heating to a temperature in the range of between about 3170° C. to about 3230° C. for a time period of approximately 2 minutes;

whereby the filament is produced comprising an interlocked grain structure of average grain size in excess of about 20 microns.

* * * * *